United States Patent [19]

Kuhn et al.

[11] 4,026,122

[45] May 31, 1977

[54] REFRIGERATION SYSTEM

[75] Inventors: Edgar D. Kuhn, Addison; Leonard E. Lathrop, Adrian; Robert J. Sanderson, Manitou Beach, all of Mich.

[73] Assignee: Primore Sales, Inc., Adrian, Mich.

[22] Filed: Oct. 11, 1974

[21] Appl. No.: 513,999

[52] U.S. Cl. ..... 62/196 C; 137/517; 417/299

[51] Int. Cl.[2] ..... F04B 49/02

[58] Field of Search ..... 62/196; 417/299; 137/517, 540

[56] References Cited

UNITED STATES PATENTS

| | | | |
|---|---|---|---|
| 2,034,153 | 3/1936 | Ploeger | 417/299 X |
| 2,043,059 | 6/1936 | Ploeger | 62/196 |
| 2,338,486 | 1/1944 | Bixler | 62/196 X |
| 2,929,399 | 3/1960 | Magowan, Jr. | 137/517 X |
| 3,296,952 | 1/1967 | Lingal | 137/517 X |
| 3,297,049 | 1/1967 | Moskovitz | 137/540 |
| 3,456,442 | 7/1969 | Brooks | 137/517 |
| 3,759,057 | 9/1973 | English et al. | 62/196 |
| 3,855,813 | 12/1974 | Laurent | 62/196 |

FOREIGN PATENTS OR APPLICATIONS

| | | | |
|---|---|---|---|
| 549,028 | 11/1957 | Canada | 62/196 |
| 1,035,170 | 7/1958 | Germany | 417/299 |

*Primary Examiner*—William E. Wayner
*Attorney, Agent, or Firm*—Barnes, Kisselle, Raisch & Choate

[57] ABSTRACT

In a refrigeration system comprising a compressor, expansion means, an evaporator and a condenser, the improvement comprising a normally open, spring-loaded valve positioned so that when the compressor is not operating a passage is provided between the compression chamber and the inlet to the compression chamber, and when the compressor is operating the passage is closed.

8 Claims, 8 Drawing Figures

REFRIGERATION SYSTEM

This invention relates to refrigeration systems and particularly to refrigeration systems wherein there are substantial loads as contrasted to air-conditioning systems.

BACKGROUND OF THE INVENTION

In refrigeration systems which utilize compressors for compressing the refrigerant, there is a tendency for the refrigerant to become trapped in the compression chamber when the compressor is stopped and, as a result there is normally a load on the compressor motor in restarting. Where an electric motor is utilized, in order to provide for prompt restarting, it is common to add a motor starting capacitor, high torque start windings on the motor stator or other devices designed to provide the motor with high initial torque capabilities. In any event, depending on the compressor and refrigeration system, the restarting is prevented for a substantial period of time on the order of minutes. The problem is most important in refrigeration systems which operate to cool to temperatures of 40° F or below, as contrasted to air conditioning systems; because in refrigeration systems, the motor capacity is kept as low as possible to minimize cost.

Accordingly, there is a need for providing a simple and effective mechanism for restarting a refrigeration system promptly, on the order of seconds after being shut off, without the use of supplementary electrical components and without adversely affecting the efficiency of the compressor.

It has heretofore been suggested that solenoid operated valves be provided to equalize the pressure between the compression chamber and the suction chamber of the compressor. Such an arrangement necessitates costly solenoid and associated electrical controls, and results in refrigerant being entrapped in the solenoid valve inlet, commonly termed re compression volume.

It has also been heretofore suggested to provide a shallow groove in the valve plate or on the suction valve seat, between the compression chamber and the suction chamber but such a continuous bleed of refrigerant during operation of the compressor reduces the capacity of the compressor substantially.

Another prior system utilizes a combined pressure relief and unloader valve between the discharge volume and suction volume of the system. Such an arrangement has the disadvantages in that it does not unload the compression chamber, is slow to unload because of the large amount of refrigerant that must be passed through the valve to equalize the pressures, is costly, reduces capacity since it has an inherent continuous bleed even when the compressor is operating, and does not provide for an immediate restart.

Accordingly among the objects of the invention are to provide a refrigeration system which will function to permit the compressor within the refrigeration system to start immediately within seconds after being shut off and without any need for waiting for the equalization of pressures between the system's discharge and suction volumes; which system is simple, reliable, effective and low in cost; and in which involves a novel compressor unloading valve.

SUMMARY OF THE INVENTION

In accordance with the invention a normally open, spring-loaded valve positioned in the compressor so that when the compressor is not operating an open passage is provided between the compression chamber and the suction chamber.

DESCRIPTION

Figure 1:
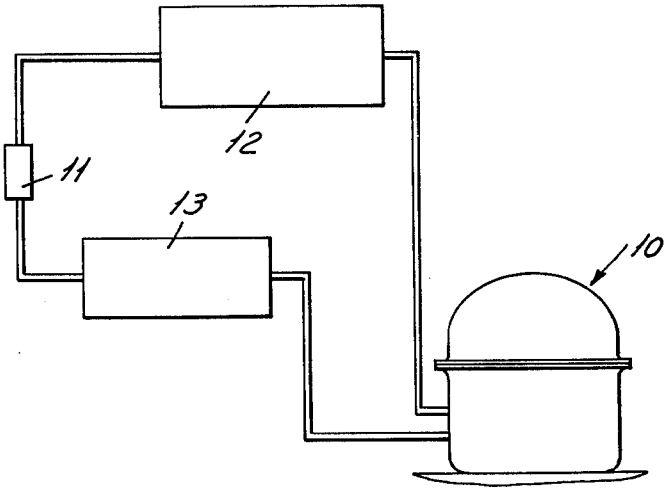
FIG. 1 is a schematic diagram of a refrigeration system embodying the invention.

Referring to FIG. 1, the invention relates particularly and is especially adapted to a refrigeration system comprising a refrigeration compressor 10 that provides refrigerant under pressure to a condenser 12 and, in turn, to expansion means 11 and thereafter to an evaporator 13 and back to the inlet of the compressor 10, in accordance with conventional construction.

Figure 2:
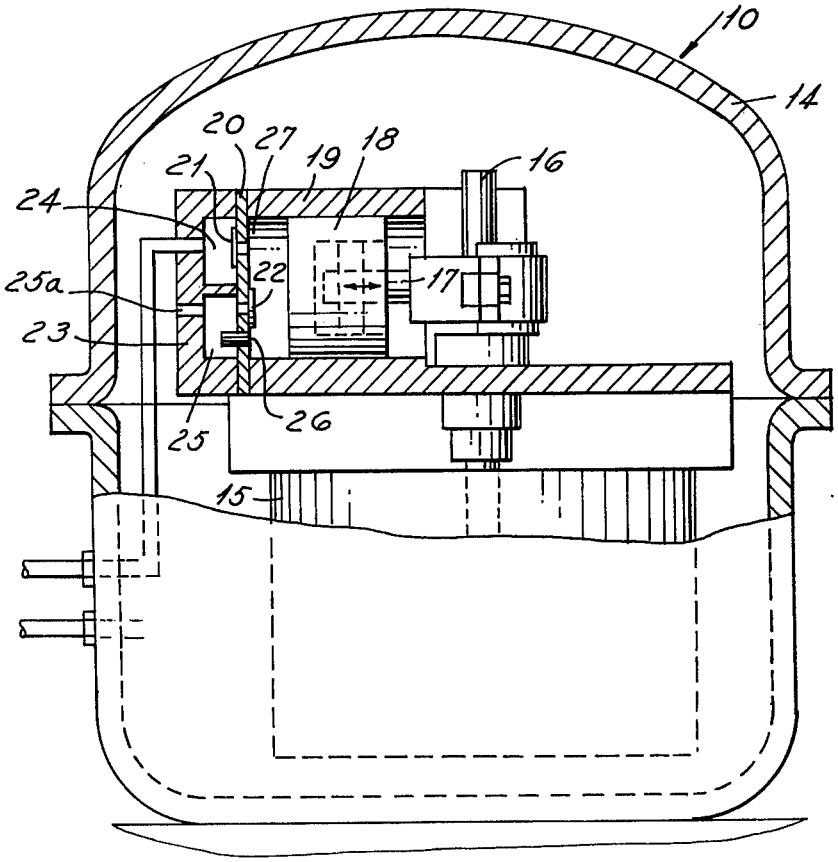
FIG. 2 is a part sectional view of a compressor forming part of the system.

As shown partly diagrammatically in FIG. 2, a conventional refrigeration compressor 10, herein shown as a hermetic compressor, comprises a shell or housing 14 in which the compressor is positioned and includes an electric motor 15 that drives the crankshaft 16 to reciprocate a crank 17 and move a piston 18 in a cylinder 19. The compressor conventionally includes valve plate 20 having discharge and suction valves 21, 22 such as leaf valves and a head 23 defining a discharge pressure area or chamber 24 and an inlet or suction area or chamber 25 which are controlled by the leaf valves 21, 22 in a conventional manner. The suction chamber 25 communicates with the area within housing 14 through an opening **25*a***.

Although the invention is described in connection with hermetic compressors it is also applicable to semi-hermetic and open type compressors.

In accordance with the invention, a normally open, unloading valve 26 is provided in valve plate 20 between the cylinder or compression chamber 27 and the inlet or suction chamber 25. The valve 26 may be inserted by press fitting in an opening in valve plate 20.

Figure 3:
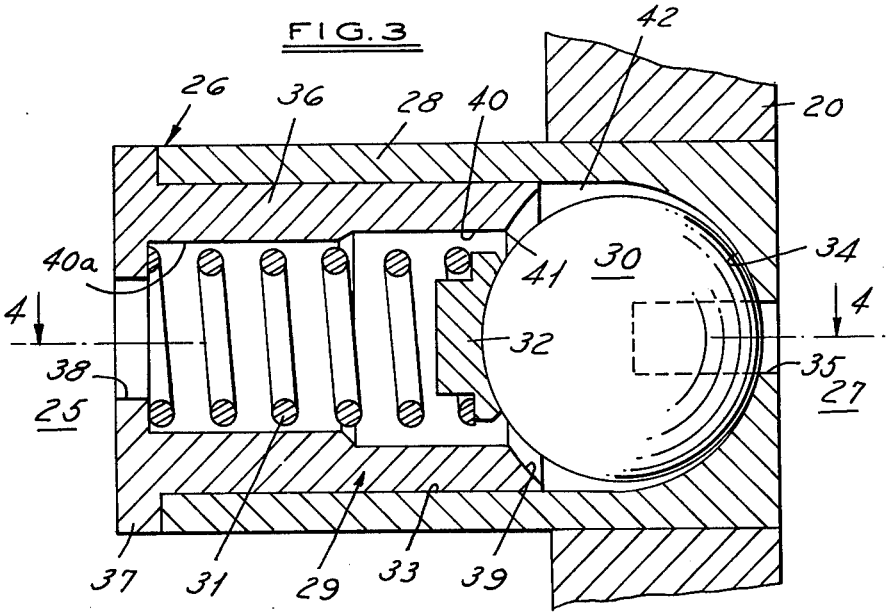
FIG. 3 is a sectional view on a greatly enlarged scale of an unloading valve utilized in the system.

Referring to FIG. 3, the unloading valve 26 comprises a body including an outer valve body portion 28, an inner valve body portion 29, a valve in the form of a ball 30 or the like, and a spring 31 interposed between the inner valve body 29 and a pressure member 32 contacting ball 30.

The outer valve body 28 includes a cylindrical opening 33 in one end that terminates in a spherical surface 34 having a radius greater than the radius of the ball 30 and defining a stop against which the ball 30 is urged by the spring 31. A diametral slot 35 is provided in the end of the outer valve body 28 adjacent the compression chamber 27.

The inner valve body 29 includes a hollow cylindrical portion 36 that telescopes within the opening 33 and fits tightly therein and a flange 37 that engages the open end of the outer valve body 28. An opening 38 is provided in the end wall of the inner valve body 29 which communicates with suction chamber 25. The inner valve body 29 further includes a surface 39 in its end adjacent to the ball which has a spherical radius greater than the radius of the ball 30. The inner surface 40 of cylindrical portion 36 has a portion 40*a* of reduced diameter to serve as a guide for spring 31. The larger inner surface 40 provides for refrigerant flow around and through the spring as shown in FIG. 4.

The surface 40 and surface 39 intersect to form a seat 41 that is engaged in line contact by the ball. In order to insure a seal during operation of the compressor either seat 41 or ball 30 are made of a resilient material. In addition, all parts of the valve 26 must be made of materials which will withstand the effects of refrigerant, refrigerant oil and temperatures encountered in refrigeration. It has been found that successful results have been achieved when the ball is made of plastic and the remaining parts are made of metal such as steel. A preferred material for the ball has been found to be fluorocarbon resin such as tetrafluoroethylene resin sold under the trademark "Teflon".

Figure 4:
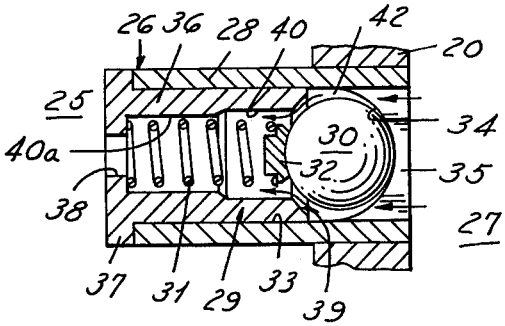
FIG. 4 is a sectional view taken along the line 4—4 of FIG. 3.
Figure 5:
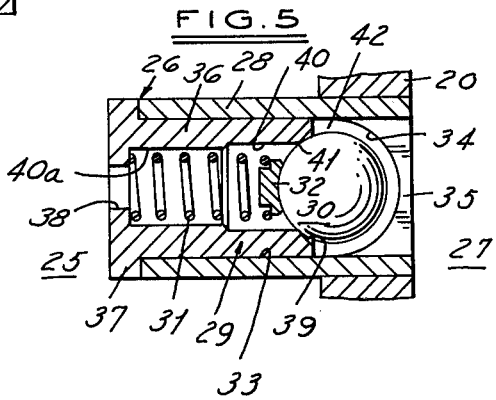
FIG. 5 is a view similar to FIG. 4 showing the parts in a different operative position.

When the compressor is not operating, the unloading valve 26 is normally open with the ball 30 being forced against the end of the outer body portion 28 (FIGS. 3 and 4). When the compressor is started, pressure in the compression chamber 27 builds and acts on the ball 30 to close the passage that is normally provided between the compression chamber 27 and the suction chamber 25 after the first few compressor revolutions. By remaining open for these initial revolutions, the compressor is allowed to reach full speed and full torque capabilities without stalling, and causing the protective overload to interrupt the motor circuit. After the unloading valve closes as shown in FIG. 5, the compression chamber pressure is maintained out of communication with the suction chamber 25 except under the normal operation of suction valve 22, and the compressor functions normally with substantially no loss in efficiency.

Typically, when a compressor is shut off, it does not come to an abrupt stop but instead makes one or more revolutions before coming to a complete stop. On the last cycle before stopping, the rotational velocity is decreased to the extent there is not sufficient torque left to build enough compression chamber pressure to keep the unloading valve 26 closed. Thus, the normally open unloading valve 26 opens and provides a passage between the compression chamber and the suction chamber. With this path open, any remaining compression revolutions are unable to build any compression chamber pressure and the compressor comes to a complete stop without trapping high pressure refrigerant in the compression chamber 27. Since there is no pressure entrapped in the compression chamber 27 and the unloading valve 26 is in the open position, the compressor is capable of substantially immediate restarting. These no-load conditions continue when the compressor is restarted for the first few compressor revolutions as indicated above to permit the compressor to start under virtually any system load conditions, as indicated by the pressure in the chamber 24.

Figure 6:
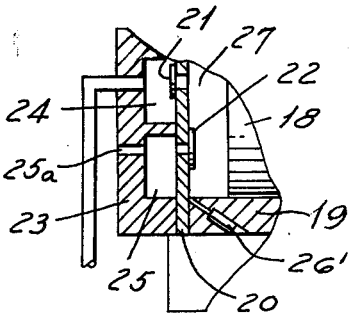
FIG. 6 is a fragmentary view similar to a portion of FIG. 2 of a modified form of the invention.

As shown, the compressor unloading valve 26 is provided in the valve plate 20, but it may also be provided in other parts of the compressor. The valve plate 20 is preferred since it is a convenient point for press fitting or otherwise positioning or holding the valve in position. Alternatively, the compressor unloading vale 26' may be provided in the cylinder wall 19 as shown in FIG. 6 providing communication between the compression chamber and the low-pressure or suction area.

An important feature of the invention is that in the closed position, the valve 30 substantially fills the space 42 between the valve seat 41 and the spherical surface 34 and has limited movement. In addition, the volume of the space of opening 35 is small. As a result, the volumetric area of refrigerant entrapped between the valve seat 41 and the compression chamber is at a minimum, and accordingly, there is a minimal volume of refrigerant recompressed and trapped on every cycle of the piston.

It is also essential that the various components of the valve be made accurately and carefully.

Figure 7:
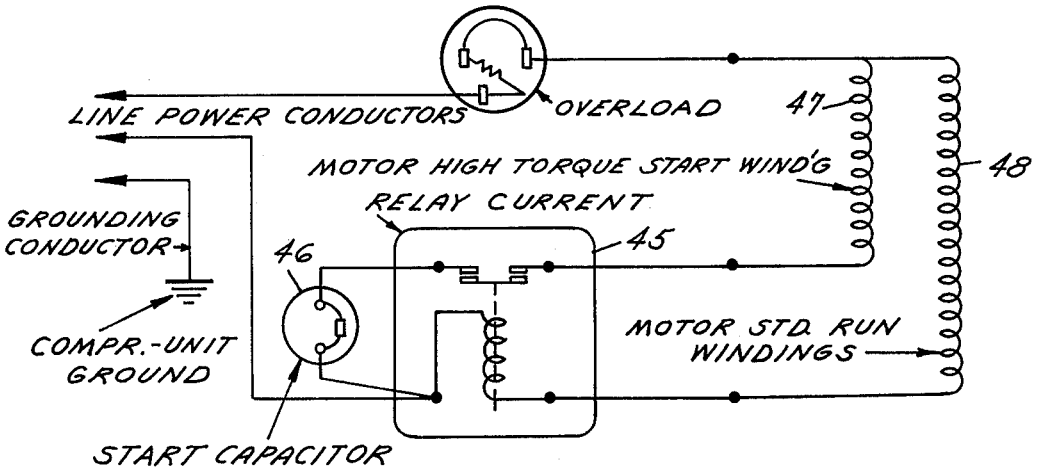
FIG. 7 PRIOR ART
FIG. 7 is a schematic wiring diagram of a prior art system.
Figure 8:
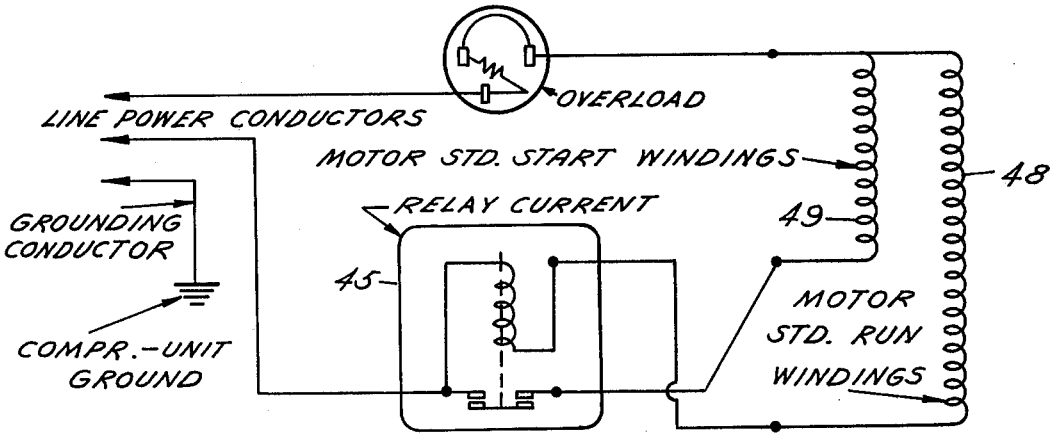
FIG. 8 is a schematic wiring diagram of a system embodying the invention.

The manner in which the invention reduces the cost of the refrigeration system may be more readily understood by reference to FIGS. 7 and 8, which are schematic wiring diagrams. The prior art system shown in FIG. 7 comprises a current relay 45, a start capacitor 46, a high torque motor winding 47 and a motor run winding 48. When the invention is incorporated in the system, as shown in FIG. 8, the start capacitor and the high torque start windings are eliminated and standard start windings 49 are used.

In a typical system for a compressor having a capacity of a nominal 1000 BTU/hr, successful results have been obtained with an unloading valve having the following dimensions:

| | |
|---|---|
| Inner diameter of outer body | .200 ± .0005 |
| Teflon ball | |
| Diameter | .1875 ± .0004 |
| Surface finish | Highly polished smooth surface |
| Hardness | Shore D50/D65 |
| Material | Virgin Teflon |
| Dimensions of slot in outer body | .020 ± .005 by .200 |
| Spherical radius of valve seat inner body | .100 ± .003 |
| Spherical radius on pressure member | .100 ± .005 |
| Spring-stainless steel free length | .230 |
| Load requirements of spring | Load rate 23.75 lbs. per inch |
| Overall diameter | .250 |
| Overall length | .429 |

In such a valve, the net interior volume can be calculated by taking given dimensions:

| | | | |
|---|---|---|---|
| r | = | radius of ball 30 | = .093 |
| R | = | radius of surface 39 | = .100 |
| R' | = | radius of surface 34 | = .100 |
| A | = | distance between center of R + R' | = .015 |
| B | = | distance between center of R and lower edge of surface 39 | = .0445 |
| C | = | distance between lower edge of surface 39 and top of ball 30 when valve is closed | = R − B = .0555 |
| D | = | A + B | = .0595 |
| E | = | inner diameter of outer body and length of slot 35 | = .200 |
| G | = | depth of slot 35 at lowest part of surface 34 | = .0105 |

The volumes can thus be calculated as follows:

$V_1$ = volume above plane containing lower edge of surface 39 containing top of ball when valve is closed =

$$\pi C^2 \left(R - \frac{C}{3}\right) = .0007887$$

$V_2$ = volume between center of surface 34 and lower edge of seat = $\pi R^2 D = .0018692$ $V_3$ = volume between plane containing center of surface 34 and surface 34 =

$$\frac{1}{2}\left(\frac{4}{3}\pi R^3\right) = .0020944$$

$V_4$ = volume of outer body slot 35 =

$$\left[(2R)(R+G) - \frac{\pi R^2}{2}\right]F = .0001278$$

$V_5$ = volume of ball =

$$\frac{4}{3}\pi r^3 = .0034515$$

The total interior volume is thus:

$$V = V_1 + V_2 + V_3 + V_4 - V_5 = 0.0014286$$

With such an unloading valve, the percentage recompression volume can be calculated if certain given dimensions of a compressor are known.

| | | | | |
|---|---|---|---|---|
| D | = | diameter of compressor cylinder | = | 1.000 |
| $d_T$ | = | distance between valve plate and top of piston in cylinder when piston is at top of stroke | = | .004 |
| $d_B$ | = | distance between valve plate and top of piston in cylinder when piston is at bottom of stroke | = | .700 |
| t | = | thickness of valve plate | = | .150 |
| d | = | diameter of discharge port | = | .141 |

Volume of discharge ports (2) =

$$V_{ports} = 2\pi\left(\frac{d}{2}\right)^2 t = .00468$$

Volume of cylinder (top of stroke) =

$$V_T = V_{ports} + \pi\left(\frac{D}{2}\right)^2 d_T = .00783$$

Volume of cylinder (bottom of stroke) =

$$V_B = V_{ports} + \pi\left(\frac{D}{2}\right)^2 d_B = .055446 = \text{Compressor Displacement}$$

Percentage recompression volume =

$$\frac{\text{Unloading valve internal volume}}{\text{Compressor displacement volume}} = \frac{.0014286}{.55446} = .00258 \text{ or } .257\%$$

It can thus be seen that there has been provided a refrigeration system wherein the system can be readily restarted without waiting long periods of time for pressure equalization between the system's discharge and suction volumes; which obviates the need for starting capacitors, additional starting or high torque windings and the associated electrical mechanisms; which is low in cost; and which can be readily applied in conventional systems with minimal modification of the compressor.

We claim:

1. In a refrigeration system comprising a compressor having a compression chamber which is cyclically varied in size to compress refrigerant and a valve plate having an inlet valve controlling the flow of refrigerant from a suction chamber to said compression chamber and an outlet valve controlling the flow of refrigerant out of said compression chamber, expansion means, an evaporator and a condenser, the improvement comprising said valve plate having a first surface adjacent said compression chamber and an opposite second surface exposed to the suction chamber, said inlet valve being associated with said first surface, said outlet valve being associated with said second surface, said valve plate having an opening extending therethrough between said first and second surfaces, a normally open spring-loaded valve, a body having an opening therethrough, a valve movable axially in said opening in said valve body, a valve seat in said body against which said valve may seat, a stop in said body, and spring means normally urging said valve away from said valve seat against said stop, said valve being positioned between said compression chamber and said suction chamber, so that when the compressor is not operating, a direct passage is provided between the compression chamber and the suction chamber, the end of said valve body nearest said stop being substantially flush with said first surface, said valve substantially filling the space between said valve seat and said stop and said valve seat being positioned relative to said body which is exposed to said compression chamber and the length of the end of the opening in the valve body nearest the compression chamber being such that there is minimal volumetric area between said valve seat and said compression chamber when said valve is against said valve seat due to pressure in said compression chamber thereby maintaining a minimum recompression volume.

2. The combination set forth in claim 1 including said valve comprising a ball, said valve body comprising an outer body portion having an opening extending from one end toward the other, the lower end of said opening defining said stop and including a spherical surface having a greater diameter than the spherical surface of the ball and an opening extending from said spherical surface to the end of the body which is exposed to compression chamber pressure, said spherical surface substantially conforming to surface of said ball, said valve body including a second body portion extending into the opening of said first-mentioned body portion and having said valve seat thereon.

3. The combination set forth in claim 2 including a pressure member engaging said ball and interposed between said spring and said ball, said spring being interposed between said inner body portion and said pressure member and comprises a compression spring.

4. The combination set forth in claim 2 wherein one of said seat and said ball is made of resilient material.

5. For use in a refrigeration system, a valve plate having a first surface and an opposed second surface, an inlet valve associated with said first surface, an outlet valve associated with said second surface, said valve plate having an opening therethrough,
a normally open spring-loaded valve in said opening,
a body having an opening therethrough,
a valve movable axially in said opening in said valve body,
a valve seat in said body against which said valve may seat,
a stop in said body,
and spring means normally urging said valve away from said valve seat against said stop,
the end of said valve body nearest said stop being substantially flush with said first surface,
said valve substantially filling the space between said valve seat and the end of said valve body adjacent said first surface of said valve plate and the length of the opening between said stop and the end of said body adjacent said first surface of said valve plate being such that a minimum volumetric area is provided between said valve seal and said end of said valve body.

6. The combination set forth in claim 5 including said valve comprising a ball,
said valve body comprising an outer body portion having an opening extending from one end toward the other,
the lower end of said opening defining said stop and including a spherical surface having a greater diameter than the spherical surface of the ball and an opening extending from said spherical surface to the end of the body which is exposed to compression chamber pressure,
said spherical surface substantially conforming to surface of said ball,
said valve body including a second body portion extending into the opening of said first-mentioned body portion and having said valve seat thereon.

7. The combination set forth in claim 6 including a pressure member engaging said ball and interposed between said spring and said ball,
said spring being interposed between said inner body portion and said pressure member and comprises a compression spring.

8. The combination set forth in claim 7 wherein one of said seat and said ball is made of resilient material.

* * * * *